United States Patent [19]

Dudley et al.

[11] Patent Number: 4,488,027

[45] Date of Patent: Dec. 11, 1984

[54] LEAKAGE SUPPRESSION TUNNEL FOR CONVEYORIZED MICROWAVE OVEN

[75] Inventors: Kenneth W. Dudley, Sudbury; E. Eugene Eves, II, Westford; William R. Stone, Lynnfield, all of Mass.

[73] Assignee: Raytheon Company, Lexington, Mass.

[21] Appl. No.: 501,322

[22] Filed: Jun. 6, 1983

[51] Int. Cl.[3] ..... H05B 9/06

[52] U.S. Cl. ..... 219/10.55 A; 219/10.55 D; 219/10.55 M

[58] Field of Search ..... 219/10.55 A, 10.55 R, 219/10.55 D, 10.55 F, 10.55 M, 10.55 E

[56] References Cited

U.S. PATENT DOCUMENTS

| | | | |
|---|---|---|---|
| 4,003,840 | 1/1977 | Ishino et al. | 252/62 |
| 4,182,946 | 1/1980 | Wayne et al. | 219/10.55 A |
| 4,227,063 | 10/1980 | Edgar et al. | 219/10.55 A |
| 4,405,850 | 9/1983 | Edgar | 219/10.55 A |

*Primary Examiner*—C. L. Albritton
*Assistant Examiner*—M. M. Lateef
*Attorney, Agent, or Firm*—William R. Clark; Joseph D. Pannone

[57] ABSTRACT

A conveyorized microwave oven having two leakage suppression tunnels in series wherein the first tunnel includes a microwave choke and a second tunnel has a ferromagnetic layer covered with a smooth microwave transparent sheet. The choke tunnel presents a high impedance to microwave energy at the operating or fundamental frequency and the second tunnel attenuates spurious out-of-band radiation which propagates through the first tunnel and is typically concentrated at the harmonics. The ferromagnetic layer absorbs the broad-banded microwave energy and the smooth microwave transparent layer such as Lexan provides a surface that is easily cleanable and acceptable for use in cooking food. The sides of the second tunnel can be pivoted to an opened position by hinges to provide easy access to the inside for cleaning.

8 Claims, 10 Drawing Figures

LEAKAGE SUPPRESSION TUNNEL FOR CONVEYORIZED MICROWAVE OVEN

BACKGROUND OF THE INVENTION

Conveyorized microwave ovens have been used in industry for many years to cook or thaw foods and provide heat for processing objects such as rubber and foundry cores. These ovens generally operate at 915 MHz or 2450 MHz because these frequencies are within narrow frequency bands designated by government agencies for such purpose. The intensity of microwave energy permited to leak from domestic and/or industrial microwave heating systems is restricted. In the United States, for example, the Department of Health and Human Services requires that the microwave energy leakage from a domestic oven not exceed one milliwatt per square centimeter in the factory or five milliwatts per square centimeter in the home. Further, the Occupational Safety and Health Administration requires a microwave energy exposure of less than ten milliwatts per square centimeter. The International Microwave Power Institute has adopted a standard for intensity of microwave energy radiation leakage which is "less than ten milliwatts per square centimeter". Furthermore, the Federal Communication Commission has regulations regarding the amount of out-of-band radiation permissible by a microwave oven. Accordingly, systems employing the use of microwave energy for processing of materials or cooking and thawing food must include apparatus to prevent the leakage of microwave energy from the enclosure.

Many industrial microwave heating applications require that there be a continuous access aperture into the cavity so that materials may be transported through the cavity by a conveyor to achieve high throughput. The suppression of microwave energy from these apertures has presented problems which are much more complex than a batch-type microwave oven which can be sealed by use of a door.

One prior art approach to the suppression of microwave energy from a conveyorized microwave system is to position a tunnel extending from the aperture and line the tunnel with a lossy material that absorbs the microwave energy as it propagates therethrough. The food or product passes through the tunnel on a conveyorized system. One lossy material used is foamed glass but this material is fragile, dirty, and smelly and, therefore, is not compatible with food processing. Furthermore, the loss of foamed glass is relatively low so that an extremely long tunnel is needed in order to have effective leakage suppression from a relatively high power cavity.

Another lossy material used is a fluid that can be pumped around microwave transparent conduits in the tunnel so that the heat resulting from absorption can be removed to a heat exchanger thereby reducing the temperature of the tunnel. Although this approach has an advantage over foamed glass in limiting temperature requirements of the tunnel, the plastic or glass tubes are easily broken. Also, the pumps and heat exchangers such as radiators are relatively expensive. Furthermore, this approach, like the foamed glass, requires that the tunnel be relatively long to provide adequate suppression and the cross-section through the tunnel must be relatively small.

Another prior art approach to the problem is to use a plurality of thin metal flaps that hang in a lossy wall tunnel. Product passing through the tunnel on a conveyor pushes the flaps aside. When the tunnel crosssection has mutually orthogonal dimensions that are substantially greater than a free space wavelength of the microwave energy and when product pushing aside the flaps is not sufficiently lossy, the flaps do not provide an effective seal.

All of the approaches described above require the microwave energy entering the tunnel to be absorbed by some lossy material. Accordingly, each of these approaches detracts from the efficiency of the overall system because the available microwave energy must be split between the product and the tunnel. An improved approach, such as that described in U.S. Pat. No. 4,227,063, uses a plurality of conductive posts to provide an effective choke of microwave energy. Although this approach provides enhanced system efficiency and effective sealing at the fundamental microwave frequency, the bandwidth of the choke is somewhat limited such that out-of-band harmonics and other spurious radiation propagate through. In view of the Federal Communications Commission regulations, the harmonics and other spurious radiation must also be prevented from leaking from the cavity.

SUMMARY OF THE INVENTION

The invention defines a conveyorized microwave oven comprising a conductive cavity having at least one continuous access opening, a magnetron for energizing the cavity with microwave energy, a first tunnel having a first end connected to the outside of the cavity and surrounding the access opening, the first tunnel providing a microwave choke for the fundamental frequency of the magnetron, a second tunnel connected to the second end of the first tunnel, the second tunnel comprising means for attenuating a broad band of microwave energy, the attenuating means comprising a first layer comprising ferromagnetic particles bonded to at least a portion of the inner surface of the second tunnel and a second layer comprising a microwave transparent material covering the first layer, and a conveyor system for transporting product to be heated through the first and second tunnels. Typically, the oven would have access openings on opposing sides so that a conveyor belt could pass therethrough. In such circumstance, a pair of tunnels would be connected at each access opening. Preferably, the first layer comprises ferrite particulate dispersed in silicone and the second layer is a sheet of Lexan. The choke tunnel presents a high impedance to the fundamental frequency of the magnetron which may typically be 915 megahertz or 2450 megahertz. The ferromagnetic particles absorb broad-band microwave energy in the second tunnel to suppress leakage of harmonics and other spurious out-of-band radiation.

The invention also defines apparatus for suppressing microwave energy leakage from a conveyorized microwave oven cavity comprising a first conductive tunnel connected to said cavity and surrounding the conveyor entrance to said cavity, said first tunnel comprising a choke having a high impedance at the fundamental frequency of the microwave energy, a pair of substantially parallel metal slats extending horizontally from the first tunnel in a direction away from the cavity for forming the sides of a second tunnel, a first panel spanned between the bottom of the slats for forming the floor of the second tunnel, a second panel spanning between the tops of the slats and supported thereby for forming the top of the second tunnel, the second panel having a first layer bonded to the underside of the second panel wherein the first layer comprises ferromagnetic particles for absorbing microwave energy escaping from the first tunnel into the second tunnel, the first layer being covered by a second layer of smooth microwave transparent material, the second panel being pivotal about hinges for providing access to the second layer for cleaning, and a conveyor belt running through the first and second tunnels for transporting objects into the cavity. Preferably, the first layer comprises ferrite particulate dispersed in silicone. Also, the second layer is preferably a sheet of Lexan. The edges of the slats may preferably be bent horizontally defining a section parallel to the first and second panels.

The invention may also be practiced by the method of fabricating a wall for a conveyorized microwave oven attenuating tunnel comprising the steps of forming a shoulder around the edge of a horizontal metal panel, covering the upper surface of the panel with a priming agent, vacuum mixing a viscous solution comprising ferromagnetic particles, a silicone elastomer, and a catalyst, depositing the viscous solution onto the priming agent on the panel, forming the viscous solution into a smooth surface layer, and pressing a smooth microwave transparent sheet down over the layer thereby providing an easily cleanable covering for the layer.

BRIEF DESCRIPTION OF THE DRAWINGS

The objects and advantages of the invention will be understood more fully in the following detailed description thereof with reference to the accompanying drawings wherein.

DESCRIPTION OF THE PREFERRED EMBODIMENT

Figure 1:
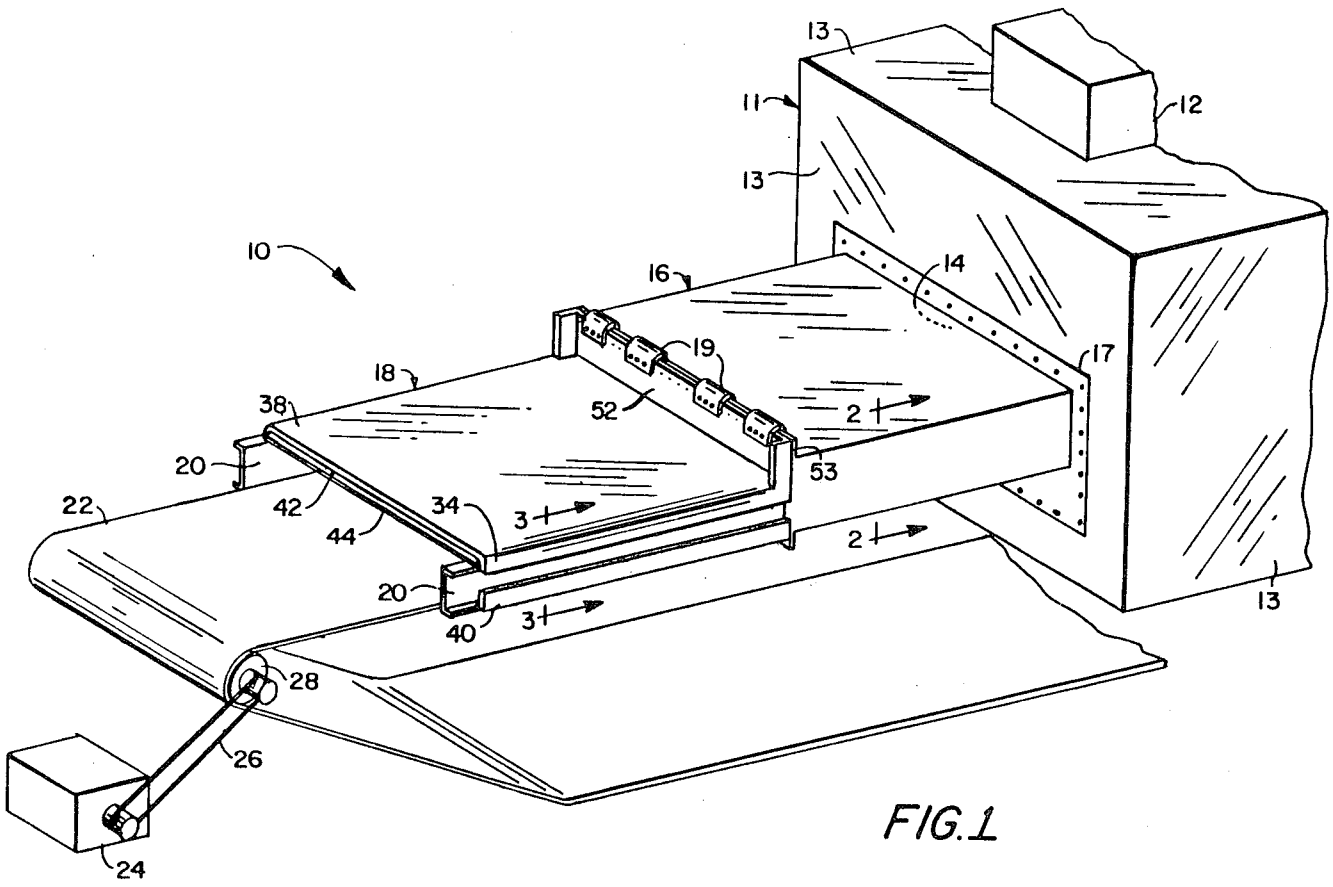
FIG. 1 is a perspective view of a conveyorized microwave oven utilizing leakage suppression tunnels.

Referring to FIG. 1, there is shown a conveyorized microwave oven 10 having advantage for cooking or thawing food and providing heat for processing product such as rubber and foundry cores. The system includes a microwave cavity 11 formed by a plurality of bounded conductive walls 13. Cavity 11 is energized with microwave energy by suitable means, such as, for example, magnetron 12 which, consistent with government regulations, may preferably operate at 915 or 2450 megahertz. At least one of the walls 13 of cavity 11 has an aperture 14 for providing continuous access to the processing region using conveyor belt 22. More specifically, it is preferable that opposing sides of the cavity have elongated apertures 14 through which a continuous conveyor belt 22 is passed. Conveyor belt 22 is driven by a motor 24 which is coupled to a drum 28 or cylinder which supports the conveyor. Chain 26 may be used to couple the motor 24 to drum 28. The motor 24 is generally connected to the output end of the conveyor belt 22 so as to pull the food or other product through cavity 11. Accordingly, FIG. 1 is representative of the output side of cavity 11 where food or other product would be removed from the cavity 11.

Microwave leakage from cavity 11 is substantially eliminated by the combination of choke tunnel 16 and attenuation tunnel 18. Choke tunnel 16, which will be described later herein with reference to FIG. 2, has a flange 17 which is connected to wall 13 of cavity 11 around access aperture 14 by suitable means such as spot welds or bolts which may preferably be spaced less than 1.5 inches apart.

Choke tunnel 16 has two substantially parallel channels 20 or slats extending outwardly in a direction away from microwave cavity 11. Channels 20 form the sides of attenuation tunnel 18. As will be described and shown in detail later herein, attenuation tunnel 18 further comprises a top and bottom which are connected to choke tunnel 16 by hinges 19 and 46, respectively, so that attenuation tunnel 18 can be opened for cleaning. It is understood that the input side to cavity 11 with a choke tunnel 16 and an attenuation tunnel 18 would appear similar except that it would not have a motor.

Figure 2:
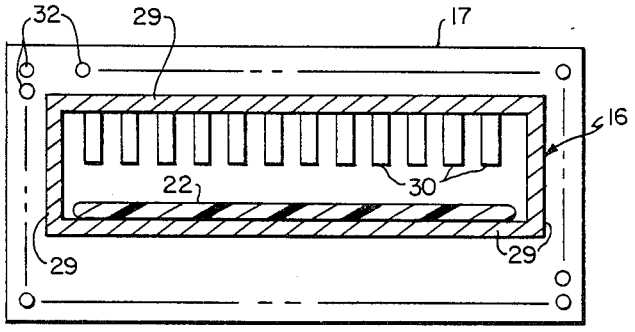
FIG. 2 is a sectional view taken along line 2—2 of FIG. 1 showing the choke tunnel.

Referring to FIG. 2, a sectioned view of choke tunnel 16 taken along line 2—2 of FIG. 1 is shown. The tunnel is formed from four rigid conductive walls 29 which are connected to flange 17 by suitable means such as welding. Flange 17, in turn, is mounted onto a wall of cavity 11 around aperture 14 by suitable means such as spot welds 32 or bolts. As is well known, conductive posts 30, suspended in rows and columns from the top wall of choke tunnel 16, provide an effective and substantially isotropic choke for microwave energy.

It is preferable that the conductive posts be approximately one-quarter wavelength long and the centers of closest adjacent posts be approximately one-quarter wavelength apart. Accordingly, for a frequency of 915 megahertz, posts 30 may preferably be approximately 3.22 inches long and the centers of closest adjacent posts may preferably be spaced approximately 3.22 inches apart. Posts 30 have diameters of approximately 0.375 inches although this dimension may not be critical. In one example of an operational configuration, tunnel 16 has a length of 26 inches and includes seven columns of posts, each spaced approximately 3.22 inches apart as defined above. In that configuration, tunnel 16 has a width of 38 inches which includes 12 rows of posts similarly spaced. It is preferable that the spacing between the bottom of the posts and the bottom wall of the tunnel be less than one-quarter wavelength. In the embodiment described above, the height of the tunnel is 6 inches so the spacing from the bottom of the posts to the bottom wall of the tunnel is approximately $2\frac{5}{8}$ inches. The choke tunnel 16 described is very effective for sealing the escape of microwave energy at the fundamental frequency of approximately 915 megahertz. Those skilled in the art will recognize that the parameters and dimensions of the tunnel and posts can be modified. Also, the parameters and dimensions will be proportionally different for microwave ovens operating at a frequency other than 915 MHz.

Figure 3:
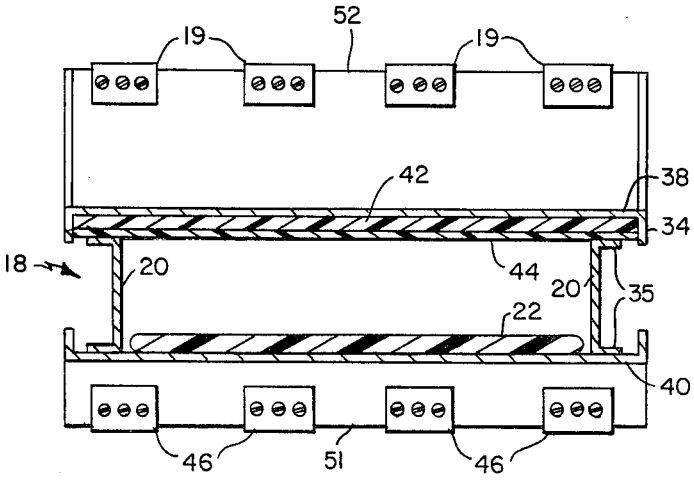
FIG. 3 is a sectional view taken along line 3—3 of FIG. 1 showing the attenuation tunnel.
Figure 4:
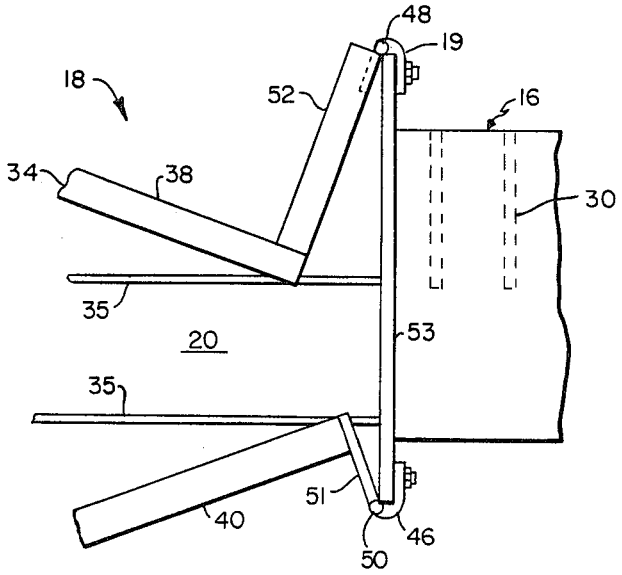
FIG. 4 is a side elevation view of the connection between the choke tunnel and the attenuation tunnel of FIG. 1.

Referring to FIG. 3, there is shown a sectional view of attenuation tunnel 18 taken along line 3—3 of FIG. 1. Also referring to FIG. 4, there is shown a side elevation view of the connection between choke tunnel 16 and attenuating tunnel 18. Attenuation tunnel 18 includes a top conductive panel 38 which spans across channels 20 or slats and forms the cover for attenuation tunnel 18. The edges 34 of top panel 38 are bent downwardly and a layer 42 of plastic material having ferrite particulate dispersed therein is bonded to the underside of panel 38. Layer 42 may preferably be covered with a sheet 44 of smooth, cleanable microwave transparent material such as Lexan. In the position as shown in FIG. 3, sheet 44 rests on the top horizontal sections 35 of channels 20 and support layer 42 and panel 38. The end of top panel 38 adjacent choke tunnel 16 includes a bracket 52 mounted perpendicularly thereto which connects to flange 53 of choke tunnel 16 by hinges 19 which includes pins 48. Accordingly, for cleaning and inspection, attenuation tunnel 18 can be pivoted upwardly about pins 48 for easy access to the under side of top panel 38 where layer 42 and sheet 44 are bonded. As shown in FIG. 4, top panel 38 is partially pivoted.

Although a smooth, cleanable surface such as Lexan is necessary for food processing, sheet 44 may be omitted in some industrial applications. However, a smooth inner surface of a high temperature plastic such as Lexan is desirable because it can easily be cleaned. Other examples of microwave transparent materials that could be used are polysulfone and acrylic resins.

Still referring to FIG. 3, a bottom conductive panel 40 forms the bottom wall of attenuation tunnel 18 and provides a surface for supporting conveyor belt 22. Although a layer 42 of microwave absorbing material is not shown bonded to panel 40, that would be an alternate embodiment if increased attenuation were desirable. Like top panel 38, bottom panel 40 has a perpendicular bracket 51 which is connected to flange 53 by hinges 46 which include pins 50. As shown in FIG. 4, bottom panel 40 is partially pivoted towards the opened position. Panel 40 which spans between the bottoms of channels 34 in the closed position are held in that position by any suitable means such as a latch. The spacing between sheet 44 and bottom panel 40 is preferably the same approximate spacing as between the bottom of posts 30 and the bottom wall of the choke tunnel 16. Needless to say, the passage ways through tunnel 16 and tunnel 18 are vertically and horizontally aligned.

In operation, magnetron 12 is activated and energizes cavity 11 with microwave energy. As is conventionally done in industrial microwave ovens, the energy may be coupled to the cavity from a plurality of directive microwave radiators each coupled to an individual magnetron or, as an alternative, a single high power magnetron such as, for example, 50 KW, may be used. Food or industrial product such as rubber or foundry cores are then fed in one end of the cavity on conveyor belt 22 and removed from the other end. As is well known and as described in U.S. Pat. No. 4,227,063, choke tunnel 16 with conductive posts 30 as defined herein substantially prevents the escape of microwave energy at the fundamental frequency such as, for example, 915 MHz from cavity aperture 14. The choking structure as defined by the configuration of conductive posts, however, is not very broad banded such that harmonics or other spurious radiation is not effectively blocked by choke tunnel 16. The ferrite particulate in layer 42 absorbs the microwave energy that is not effectively choked in choke tunnel 16. Accordingly, a safe environment is created for the operators of the oven and Federal Communications Commission standards are met. Generally, other ferromagnetic particles such as iron could be used in place of the ferrite particles but they may be more expensive and have a smaller bandwidth of microwave absorption. The power of the out-of-band microwave energy entering attenuation tunnel 18 is relatively small compared to the power within cavity 11 because most of the energy is at the fundamental frequency and sealed by choke tunnel 16; accordingly, there generally will not be a requirement to provide apparatus to remove heat from attenuation tunnel 18. Choke tunnel 16 doesn't heat because it isn't lossy.

The thickness of layer 42 may be varied so that the peak attenuation is near the second harmonic where the chance of spurious radiation is the highest. For example, for a 2450 MHz oven, the maximum attenuation would preferably peak at about 4900 MHz which may result in a thickness of 3/16 of an inch for layer 42. For a 915 MHz oven where the second harmonic is 1830 MHz, a thickness of approximately $\frac{3}{8}$ of an inch may be desirable. For the preferred embodiment described heretofore and defined by a fabrication process discussed later herein, the attenuation has been found to be on the order of 30 to 50 db per foot. This high attenuation is very desirable because the tunnels can be made relatively short thereby saving valuable factory floor space.

Figure 6:
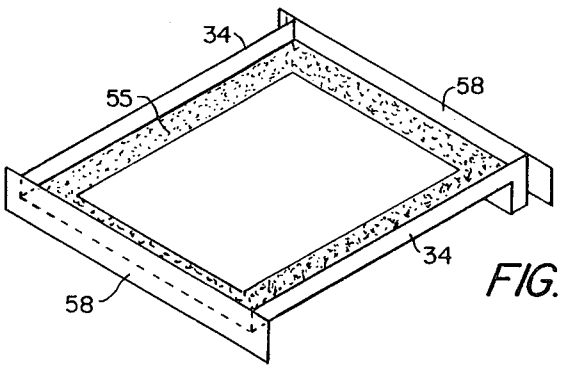
FIG. 6 is the second step in fabricating the attenuation tunnel.
Figure 5:
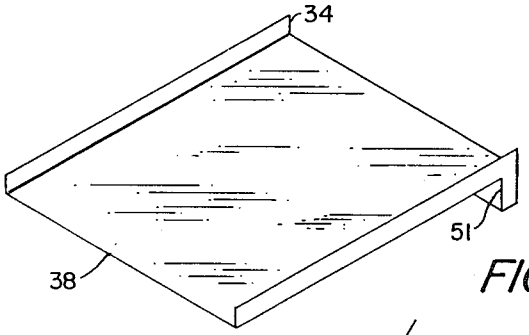
FIG. 5 is the first step in fabricating the attenuation tunnel.
Figure 7:
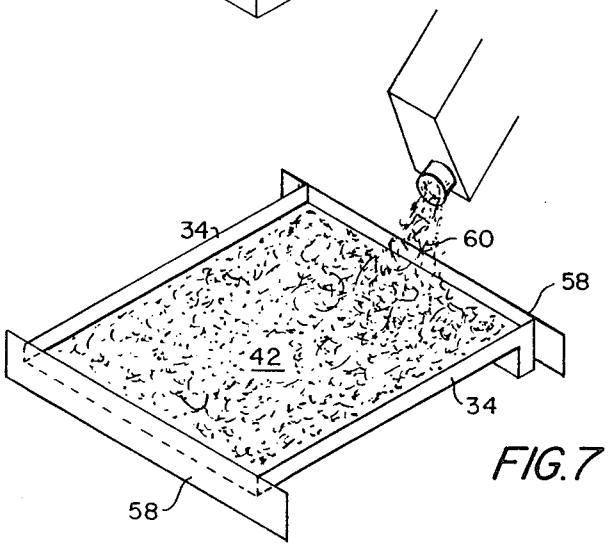
FIG. 7 is the third step in fabricating the attenuation tunnel.

Referring to FIGS. 5–8, sequential steps in the fabrication of the top of attenuation tunnel 18 are illustrated. In the first step as shown in FIG. 5, the top panel 38 is formed with bracket 52 and the edges 34 on two sides. An example of an area is 34 inches long and 40 inches wide. Next, as shown in FIG. 6, the open ends are dammed up by suitable means such as strips 58. It is preferable that strips 58 have a height of approximately the intended thickness of layer 42 so that they may be used as guides for attaining that thickness. More specifically, for the description of this particular embodiment for a 915 MHz oven, strips 58 may preferably have a height of $\frac{3}{8}$ of an inch above the surface area of panel 38. Also, an approximately 2-inch border 55 around the panel is rubbed with coarse emery cloth to obtain better adhesion of layer 42 around the edges; it has been found that if the whole surface is sand blasted, the panel is more subject to warping. Before the step in FIG. 7, the surface of panel 38 is primed with a thin coat of Dow Corning 1200 primer or equivalent. Then, as shown in FIG. 7, the viscous solution 60 forming layer 42 is poured onto panel 38. The solution is prepared by mixing approximately 12 pounds of Dow Corning Silastic E with approximately 1.2 pounds of its specified catalyst or curing agent in a vacuum mixer at an absolute pressure of approximately 2 inches of mercury. It is stirred using an electric mixer while under vacuum to de-aerate the mix. This is an important step because air bubbles underneath sheet 44 will weaken the bond between the two. After adding approximately 31 pounds of Q1 ferrite as available from Indiana General and mixing thoroughly, the viscous solution 60 is poured onto panel 38 in a fairly even layer leaving it slightly thicker on one side near an edge 34. The last of the solution should not be scraped from the mixing bucket because this gets too much air into the solution. A channel screed is pulled across strips 58 from the side where the solution is a little thicker thereby leveling layer 42. The thickness should be approximately ⅜ of an inch and the strips 58 are used as guides.

Figure 8:
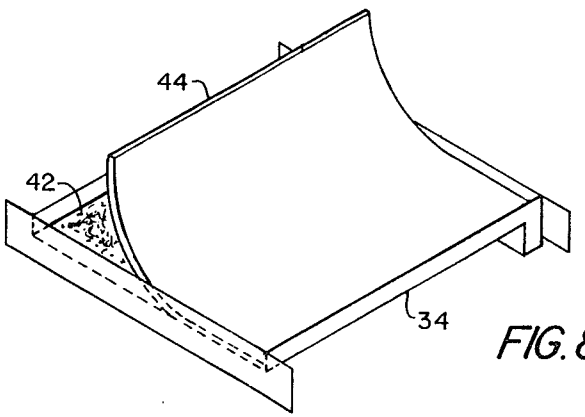
FIG. 8 is the fourth step in fabricating the attenuation tunnel.

Before the step of FIG. 8, a 1/16 inch thick Lexan sheet 44 is cut to approximately 33.88 inches by 39.88 inches and one side is primed using a cloth slightly dampened with Q3-6060 primer from Dow Corning. This priming should be done in advance because the primer should dry for approximately one hour and the Lexan should be laid on layer 42 shortly after the layer is poured. The primed side of the Lexan should be downward and should be pressed or rolled from one side to the other forcing out air from underneath it. The Silastic E silicone cures in about three days at 72° F. or one hour at 110° F; higher curing temperatures may cause distortion. Then, panel 38 is inverted and hinged to flange 53 as described earlier herein.

Figure 9:
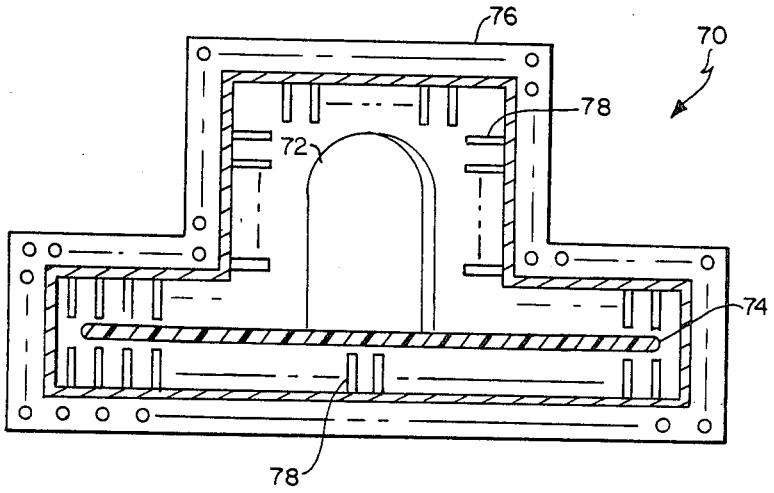
FIG. 9 is a sectional view of a choke tunnel that is an alternate embodiment of the tunnel shown in FIG. 2.

Referring to FIG. 9, there is shown a sectional view of a choke tunnel 70 which is an alternate embodiment of choke tunnel 16. Choke tunnel 70 has advantage for use in curing rubber objects 72 in a 2450 MHz microwave oven. Choke tunnel 70 has an upside-down T-shape with conveyor belt 74 running through the bottom wide section and oversized rubber objects 72 passing through the central higher section. Choke tunnel 70 is connected to the wall of the cavity by a plurality of spot welds or bolts on flange 76. The interior of the tunnel except for the sides of the bottom section is lined with conductive posts 78 which are approximately one-quarter wavelength long and having centers of closest posts being spaced approximately one-quarter wavelength apart. Accordingly, at the frequency of 2450 MHz, conductive posts 78 are approximately 1.2 inches long. The principle of operation of choke tunnel 70 is similar to that of choke tunnel 16 and described with reference to FIG. 2.

Figure 10:
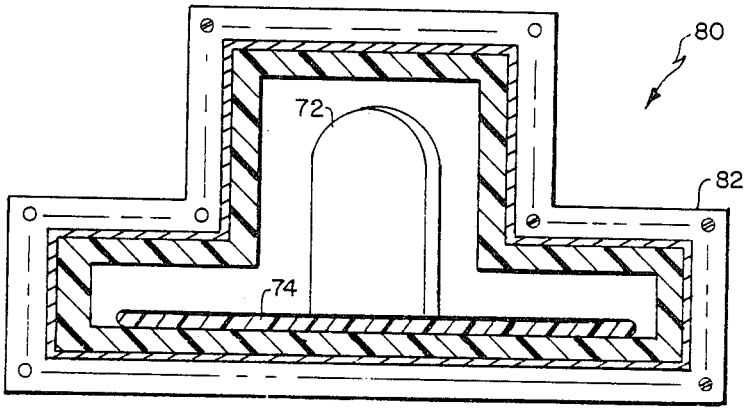
FIG. 10 is a sectional view of an attenution tunnel that is an alternate embodiment of the tunnel shown in FIG. 3.

Referring to FIG. 10, there is shown an attenuation tunnel 80 which is an alternate embodiment of attenuation tunnel 18 as described with reference to FIG. 3. The entire perimeter of the inside of tunnel 80 is lined with a layer 84 of ferrite particulate dispersed in silicone such as described with reference to layer 42 in FIG. 3. The layer of Lexan 44 as shown in FIG. 3 is not present in the embodiment of FIG. 10 because this industrial application is for rubber processing and there is no requirement to have such a surface adjacent to the product. Furthermore, because there is no requirement to continuously clean the inner surface of attenuation tunnel 80, it has a flange 82 which is bolted to a flange (not shown) of choke tunnel 70. In other words, the two respective tunnels are not hinged together so that attenuation tunnel 80 may be pivoted open.

When using a Lexan sheet 44 for food processing equipment such as shown in FIG. 1, the temperature of the Lexan must be maintained below 250° F. In an application for curing rubber such as shown in FIGS. 9 and 10 when no Lexan is used, hot air may also be directed into the microwave cavity and the temperature of the air may therefore reach 350° to 400° F.

This concludes the description of the preferred embodiment. The reading of it will suggest many modifications and alterations without departing from the spirit and scope of the invention. Accordingly, it is intended that the scope of the invention be limited only by the appended claims.

What is claimed is:

1. A conveyorized microwave oven, comprising:

a conductive cavity having at least one continuous access opening;

a magnetron for energizing said cavity with microwave energy;

a first tunnel having a first end connected to the outside of said cavity and surrounding said access opening, said first tunnel providing a microwave choke for the fundamental frequency of said magnetron;

a second tunnel connected to the second end of said first tunnel, said second tunnel comprising means for attenuating a broad band of microwave energy, said attenuating means comprising a first layer bonded to at least a portion of the inner surface of said second tunnel wherein the first layer comprises ferromagnetic particles;

a second layer comprising a microwave transparent material covering said first layer; and a conveyor system for transporting product to be heated through said first and second tunnels.

2. The oven recited in claim 1 wherein said first layer comprises ferrite particulate dispersed in silicone.

3. The oven recited in claim 2 wherein said second layer is a sheet of Lexan.

4. Apparatus for suppressing microwave energy leakage from a conveyorized microwave oven cavity, comprising:

a first conductive tunnel connected to said cavity and surrounding the conveyor entrance to said cavity, said first tunnel comprising a choke having a high impedance at the fundamental frequency of said microwave energy;

a pair of substantially parallel metal slats extending horizontally from said first tunnel in a direction away from said cavity for forming the sides of a second tunnel;

a first panel spanned between the bottom of said slats, said first panel forming the floor of said second tunnel;

a second panel spanning between the tops of said slats and supported thereby for forming the top of said second tunnel, said second panel having a first layer bonded to the underside of said second panel wherein said first layer comprises ferromagnetic particles for absorbing microwave energy escaping from said first tunnel into said second tunnel, said first layer being covered by a second layer of smooth microwave transparent material;

said second panel being pivotal about hinges for providing access to said second layer for cleaning; and a conveyor belt running through said first and second tunnels for transporting objects into said cavity.

5. The apparatus recited in claim 4 wherein said first layer comprises ferrite particulate dispersed in silicone.

6. The apparatus recited in claim 5 wherein said second layer is a sheet of Lexan.

7. The apparatus recited in claim 4 wherein the edges of said slats are bent horizontally defining sections parallel to said first and second panels.

8. The method of fabricating a wall for a conveyorized microwave oven attenuation tunnel, comprising the steps of:

forming a shoulder around the edge of a horizontal metal panel;

covering the upper surface of said panel with a priming agent;

vacuum mixing a viscous solution comprising ferromagnetic particles, a silicone elastomer, and a catalyst;

depositing said viscous solution onto said priming agent on said panel;

forming said viscous solution into a smooth surfaced layer; and pressing a smooth microwave transparent sheet down over said layer and bonding it thereto thereby providing an easily cleanable covering for said layer.

* * * * *